United States Patent [19]

Urbank

[11] 3,974,594

[45] Aug. 17, 1976

[54] ELEVATOR TEE DEBURRING DEVICE

[75] Inventor: Stanley T. Urbank, New Eagle, Pa.

[73] Assignee: United States Steel Corporation, Pittsburgh, Pa.

[22] Filed: July 21, 1975

[21] Appl. No.: 597,952

[52] U.S. Cl. ..... 51/3; 51/40; 51/178

[51] Int. Cl.[2] ..... B24B 7/02

[58] Field of Search ..... 51/3, 32, 34 C, 40, 51/80 R, 178, 241 LG

[56] References Cited

UNITED STATES PATENTS

| | | | |
|---|---|---|---|
| 1,966,869 | 7/1934 | Owen | 51/40 |
| 2,505,815 | 5/1950 | Wodetzky | 51/40 |
| 2,722,087 | 11/1955 | Hamilton | 51/32 |
| 2,926,460 | 3/1960 | Ackerman | 51/40 X |
| 3,768,350 | 10/1973 | Coulter | 51/40 X |
| 3,883,323 | 5/1975 | Cooley | 51/178 |

*Primary Examiner*—Al Lawrence Smith
*Assistant Examiner*—James G. Smith
*Attorney, Agent, or Firm*—John F. Carney

[57] ABSTRACT

Apparatus is disclosed that is operative to grind burrs from the ends of rails that have been saw cut to length. A manually positionable crosshead carries three grinding wheels, two of which are oppositely spaced and spring biased into engagement with oppositely facing surfaces of the rails. The other grinding wheel is effective to operate on the rail surface bridging the oppositely facing surfaces. Means are provided for urging the oppositely spaced grinding wheels apart during retractive movement of the crosshead. A retractable workpiece stop may be provided to position the workpiece with respect to the grinding wheels.

10 Claims, 5 Drawing Figures

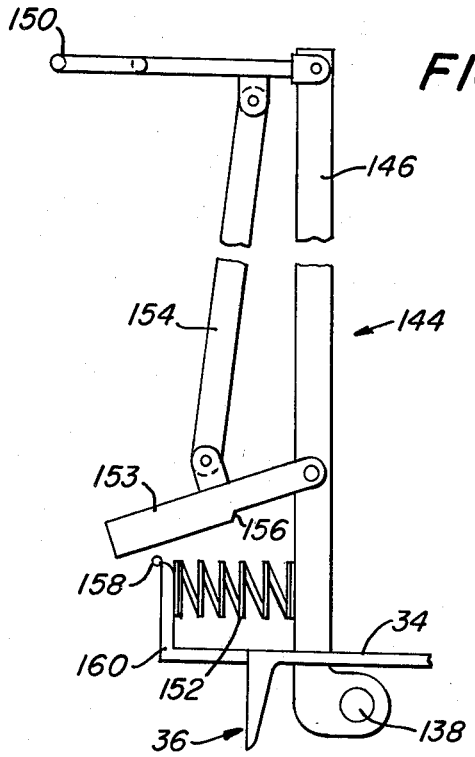
FIG. 4
FIG. 5
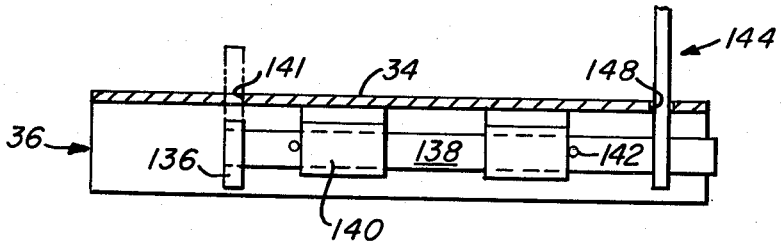

ELEVATOR TEE DEBURRING DEVICE

BACKGROUND OF THE DISCLOSURE

In the manufacture of T-rails employed as part of the track structure in elevator systems, the rails are cut to the desired length by a rotary friction saw. This operation results in a burr upset being formed on the end of the rail along the side surfaces of the web and the top thereof which must be removed before subsequent finishing operations can be performed.

In the past the burrs were removed by a workman employing a hand operated grinding device. Because of the manual nature of the operation, it is both arduous and time-consuming and therefore, amounted to a significant factor in the overall cost of rail fabrication. Adding to the expense of this operation is the fact that, due to the time required for its performance, the operation can not be performed on the roll line thereby requiring the bundling of a number of rails for their transport to a remote location followed by unbundling to permit access to the burred ends by a workman. Following this, the deburred rails were again bundled for transport to a loading facility and subsequent shipment.

Apparatus is known which is effective to mechanically deburr workpieces in situ on a fabricating line. Such apparatus is shown and described in U.S. Pat. No. 2,722,087, issued Nov. 1, 1955 to A. E. Hamilton and involves the manipulation of grinding wheels by a complex hydromechanical linkage mechanism with ancillary workpiece stepping and hold down means. In addition to being a more expensive piece of equipment in its mechanical assemblage, the apparatus is not totally operable on workpieces of T-shaped configuration on a rolling line.

It is to the improvement therefore of apparatus of the above-described type that the present invention is directed.

SUMMARY OF THE INVENTION

According to the present invention there is provided apparatus for the in-line simultaneous grinding of oppositely facing surfaces of a workpiece on a fabricating line which apparatus comprises a frame, means for fixedly supporting a workpiece with respect to said frame, a crosshead movably mounted on said frame, means for moving said crosshead alternately toward and away from said workpiece, a pair of oppositely spaced motor operated grinding wheels carried by said crosshead, spring means operative to urge said grinding wheels toward one another into engagement with said workpiece during movement of said crosshead toward the same and cam means on said frame for moving said grinding wheels away from one another during movement of said crosshead away from said workpiece.

It is accordingly a principle object of the invention to provide apparatus of the described type that produces accurate and effective in-line removal of burrs from a rail workpiece on a fabricating line.

It is another object of the invention to provide apparatus of the described type that eliminates the need for hand grinding of burr edges and excessive handling of the rails to be ground thereby to significantly reduce fabrication costs thereof.

For a better understanding of the invention, its operating advantages and the specific objectives obtained by its use, reference should be made to the accompanying drawings and description which relate to a preferred embodiment thereof.

BRIEF DESCRIPTION OF THE DRAWINGS

FIG. 4 is a view taken along line 4—4 of FIG. 3 illustrating the workpiece stop actuating mechanism embodied in the rail grinding apparatus; and FIG. 5 is a view taken along line 5—5 of FIG. 1 illustrating the workpiece stop and part of its actuating mechanism.

DESCRIPTION OF A PREFERRED EMBODIMENT OF THE INVENTION

Figure 3:
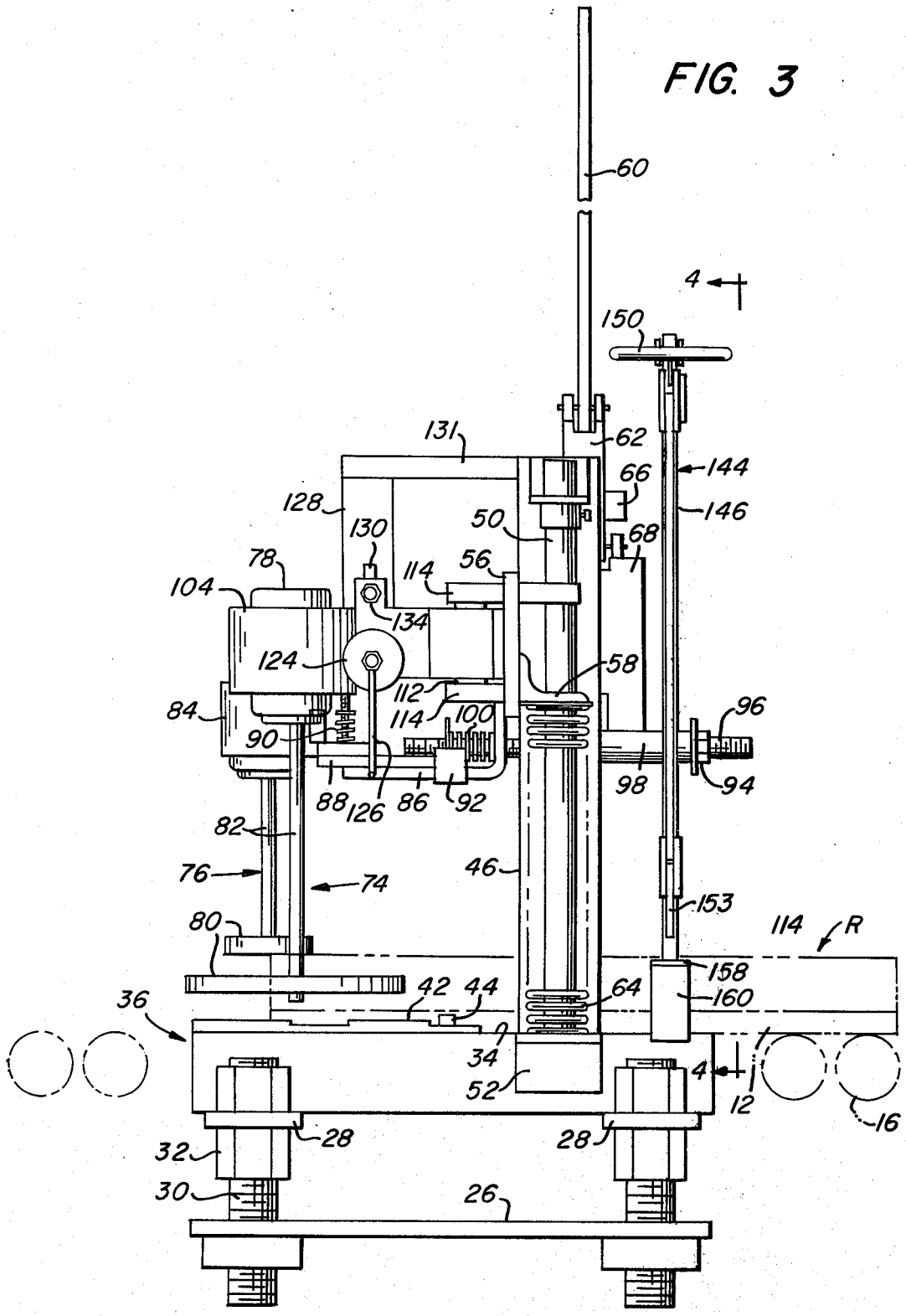
FIG. 3 is a side elevational view of the rail grinding apparatus of FIG. 1 including part of the rail transport system of the fabrication line.

There is shown in the drawings grinding apparatus 10 for operating on the ends of elongated rails R having a T-shaped cross section including a base flange 12 and a web 14 extending perpendicularly thereto. As shown best in FIG. 3, the apparatus 10 is positioned in a rail production line in alignment with the rail transport path defined by transport rolls 16 downstream of a radial friction saw station (not shown) at which the rails are cut to length. The rails R emerging from the saw station thus contain burrs at the leading ends thereof. The apparatus of the present invention is adapted to remove those burrs along the oppositely facing surfaces 18 and 20 of the web 14 and the bridging surface 22 therebetween.

The rail grinding apparatus 10 comprises a frame structure indicated generally as 24 including a base plate 26 and parallelly disposed support plates 28, mounted for relative vertical adjustment by means of four threaded posts 30 disposed at the corners of the respective plates and carrying adjustment nuts 32 thereon. A workpiece support formed by the upper surface 34 of an inverted channel 36 is fixed as by welding along the edges of the oppositely spaced webs 38 to the support plate 28 to define an elevated rail support surface and an enclosed space 40 subjacent thereto. A pair of oppositely spaced rail guide members 42 are secured for lateral adjustment on the surface 34 by means of threaded connectors 44 attaching the members to the support member 36.

A frame wall 46 constructed from an upstanding channel extends perpendicularly with respect to the surface 34 of workpiece support 36. The wall 46 contains a T-shaped through opening 48 to accommodate passage of a rail R onto the workpiece support surface 34. A pair of upstanding posts 50 are disposed each adjacent the respective sides of the frame wall 46 and slightly outboard thereof being secured at their opposite ends to angle members 54 and 52 integrally attached to the upper end of the frame wall and to the workpiece support 34 respectively. The posts 50 slidably mount a crosshead 56 which extends transversely of the frame wall 46 in close proximity thereto and which contains bracket members 58 extending outwardly from the rear surface of the crosshead, the latter having openings that slidably engage the posts 50. The crosshead 56 is urged downwardly by means of a pivoted actuating lever 60 and link 62 against compression springs 64 concentrically disposed about the posts 50, the springs biasing the crosshead upwardly following removal of the actuating force from the lever 60. The lever 60 is pivotally mounted at one end to pivot pin 66 on the frame wall 46 and the link 62 extends between an intermediate point on the lever and a mounting bushing 68 extending rearwardly from the crosshead 56 through a vertically elongated slot 70 in the frame wall to accommodate the same.

The crosshead 56 is adapted to carry three electrically operated rotary grinders, 72, 74 and 76 which are each of well known construction, consisting essentially of a motor housing 78 and an abrasive grinding wheel 80 the latter being mounted for rotary movement in axially spaced relation from the housing on a shaft 82. In the drawings grinders 72 and 74 are laterally spaced side grinders adapted to remove burrs from the oppositely facing side surfaces 18 and 20 of the web 14 of rail R. The center grinder 76 is mounted in substantially stationary relation to the crosshead during operation of the apparatus; however, means are provided to adjust the spacing of the grinder with respect to crosshead thereby to distribute the wear area on the face of the abrasive grinding wheel. Thus the center grinder 76 is mounted in a clamp bracket 84 adapted for forward slidable movement on a plate 86 that is fixed to the front face of the crosshead extending outwardly therefrom. As shown best in FIG. 3, the clamp bracket 84 is spring-mounted on a slide plate 88 by means of spring mounting 90 that retains the bracket 84 on the slide plate in a manner to absorb vertically imposed shock forces thereon. The slide plate 88 is retained on the fixed plate 86 by guide arms 92 attached to the latter. Positional adjustment of the center grinder 76 is effected by torque nut 94 on threaded shaft 96, the latter being fixed to the slide plate and extending rearwardly thereof through the crosshead 56 and bushing 98 attached to the lower end of member 68. Lateral shock forces on the mechanism are absorbed by a compression spring 100 that extends between the front surface of the crosshead 56 and a fixed abutment on the slide plate 88.

The side grinders 72 and 74 are mounted on the crosshead 56 for oppositely acting lateral movement toward and away from each other during vertical movement of the crosshead. As shown, the respective grinders are retained in mounts 102 and 104, each comprising an elongated body 106 extending from the front face of the crosshead and having a clamp portion 108 at one end adapted to engage the motor housing 78 of the respective grinders. At the other end the bodies 106 are each provided with a bushing 110 containing pivot pin 112 that engages pivot brackets 114 on the crosshead.

The grinder mounts 102 and 104 are spring biased toward each other by means of springs 116 mounted on a threaded shaft 118 that extends transversely of the mounts, extending through openings provided in the mount bodies 106 to accommodate passage of the shaft. The springs 116 are arranged to engage the mount bodies on remote sides thereof and are retained on the shaft by a fixed end stop 122 at one end and a nut 124 at the other end. The compressive force imparted by the springs 116 can be adjusted by rotation of the shaft 118 and a crank 126 is provided at the end of the shaft for this purpose.

Retractive lateral movement of the grinders 72 and 74 is produced by the action of a cam 128 in association with cam followers 130 on the mounts 102 and 104. The cam 128 is fixedly secured to the upper end of frame wall 46 by means of a spacer arm 131 that locates the cam forwardly of the frame wall and in lateral alignment with the position of the cam followers 130 on the respective mounts 102 and 104. The cam followers 130 are rotatably mounted on threaded shafts 132 which are adjustably received in a threaded hole provided in an integral upstanding appendage to the mount bodies 106. Lock nuts 134 enable the cam followers to be secured in their selected position.

As shown, the cam 128 is provided with upwardly divergent sides which are engaged by the respective cam followers 130 when the crosshead 56 is urged upwardly by the springs 64 upon release of the lever 60. This engagement causes the respective grinder mounts 102 and 104 to be laterally oppositely displaced against the action of springs 116 thereby preventing the grinding wheels from contacting one another when not in contact with the workpiece R.

In FIGS. 4 and 5 is shown mechanism utilized to actuate a workpiece stop 136 which is operable to engage the leading end of a rail R on the transport rolls 16 thereby to locate the workpiece with respect to the grinders. The stop 136 is fixedly attached at one end of a shaft 138 which is pivotally mounted by means of journal brackets 140 to the undersurface of channel 36 in space 40. Position pins 142 on the shaft 138 prevent axial movement thereof with respect to the brackets 140. As shown best in FIG. 5 the stop 136 is allowed to pass through the upper surface 34 into workpiece-engaging position through a lateral slot 141 provided therein.

Figure 1:
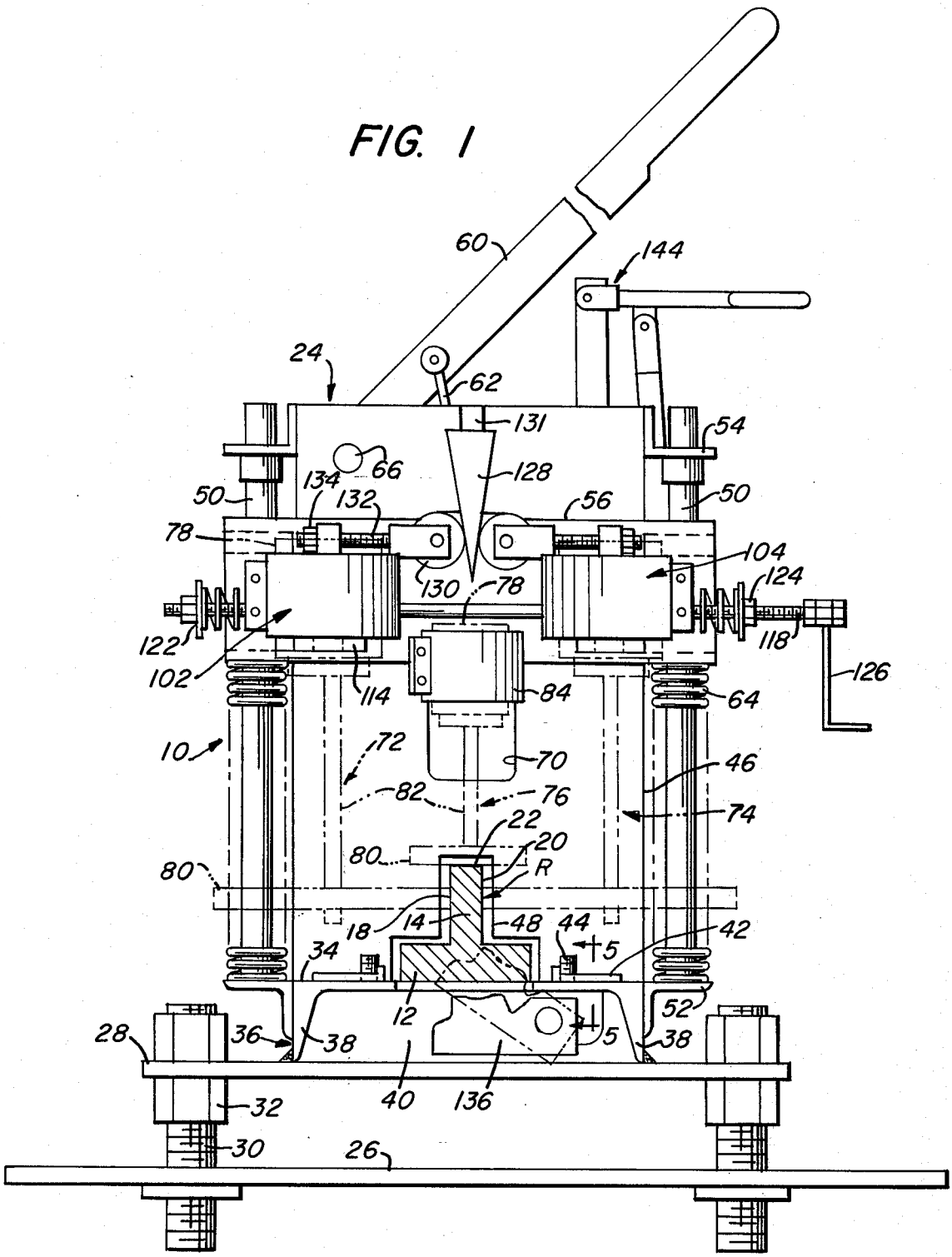
FIG. 1 is a front elevational view partly broken away of rail grinding apparatus constructed according to the present invention.
Figure 2:
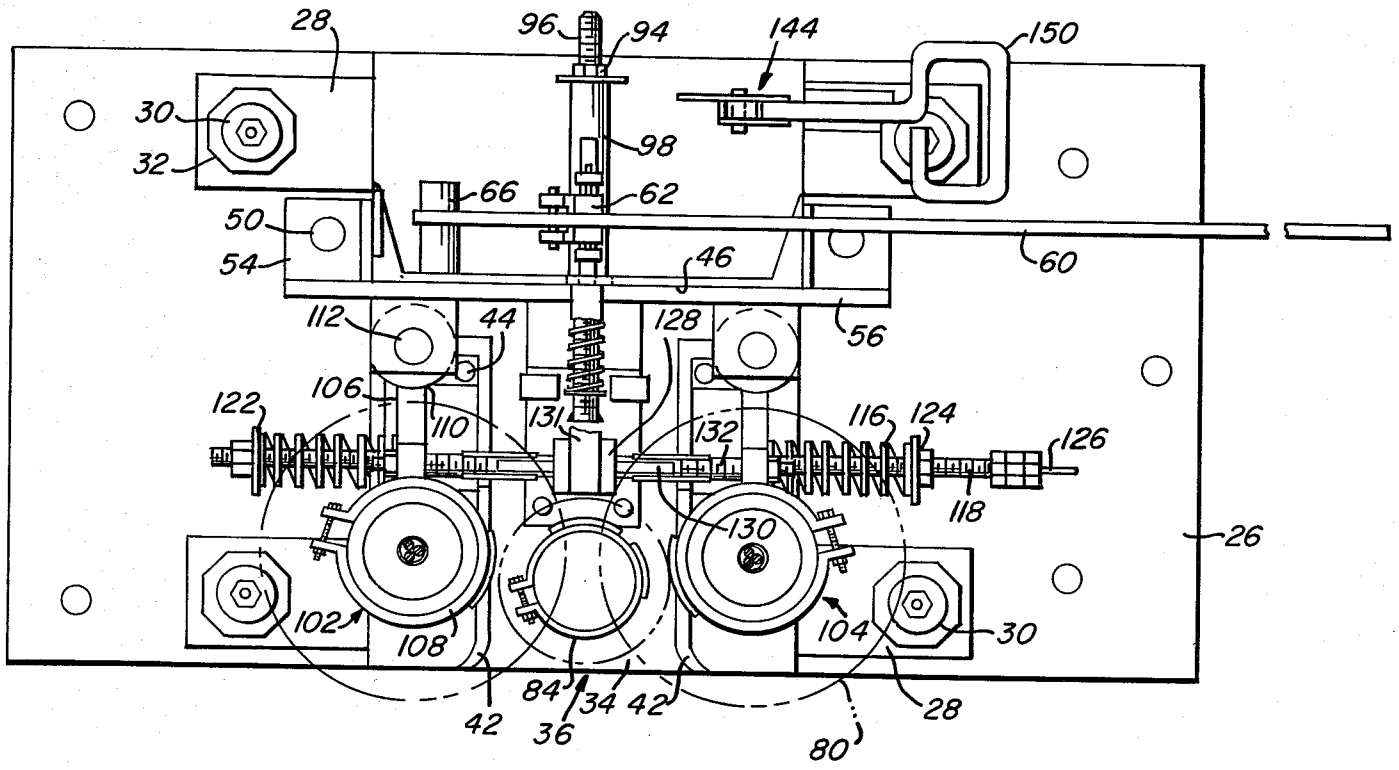
FIG. 2 is a plan view of the rail grinding apparatus of FIG. 1.

The stop 136 is manually actuated by lever mechanism indicated generally as 144 and shown best in FIG. 4. The mechanism 144 comprises a lever arm 146 attached to the end of the shaft 138 opposite that attaching the stop 136. The lever arm is caused to extend through slot 148 in the upper surface of channel 36. A handle 150 articulated at the free end of the lever arm effects rotational movement of the shaft 138 and thereby selective pivotal movement of the stop 136 into its rail stopping position shown by dotted lines in FIGS. 1 and 5. A compression spring 152 attached to a backing plate formed by an angle mounted on the channel 36 serves to urge the mechanism to locate the stop 136 in its retracted position.

The mechanism 144 further includes a locking member in the form of a pivotable body 153 pin-connected to the lever arm 146 and actuable by a link 154 which is pivotally connected at one end to the handle 150 and at its other end to the body. The locking member body 153 is formed on one edge with a shoulder 156 adapted to engage a rib 158 formed along the end edge of the backing plate 160. When in engagement with the rib 158, the locking member operates to secure the stop 136 in its rail-abutting position.

The operation of the hereindescribed apparatus is as follows: As a T-rail workpiece R is conveyed by rolls 16 along its transport path a workman operates handle 150 of the stop mechanism to rotate the lever 146 and shaft 138 thereby to pivot the stop 136 from its retracted position in space 40 through slot 141 in the channel 36 into its raised, rail-abutting position. The stop is locked in position by engagement of the locking member 153 with backing plate rib 158. In travelling to the stop 136 the leading end of the T-rail passes through opening 48 in the frame wall 46 and is guided into position by guide members 42. Once the rail abuts the stop 136 its leading end, containing the burrs to be removed, is positioned in vertical alignment with the rotary grinders 72, 74 and 76. Thereafter, the workman operates lever 60 to urge the crosshead 56 that mounts the grinders 72, 74 and 76 downwardly against the force of compression springs 64. During downward movement of the crosshead, the side grinder mounts 102, 104 are caused to converge under the influence of springs 116. With the crosshead 56 in the down position, the abrasive wheels of the side grinders 72 and 74 are brought to bear upon the burrs on the surfaces 18 and 20 of the rail web 14 and that of the center grinder 76 engages the bridging surface 22 therebetween.

Upon completion of the burr-grinding operation the lever 60 is released and the crosshead 56 moves upwardly away from the workpiece under the influence of the compression springs 64. Due to the camming action produced by followers 130 on the surface of cam 128 the side grinders 72 and 74 are urged away from one another to prevent contact between their respective abrasive wheels 80.

Following release of the lever 60 the workman lifts handle 150 to release the lock between shoulder 156 and rib 158 thereby to pivot the lever arm 146 under the influence of spring 152 and retract the workpiece stop 136 to the space 40 enclosed by the channel 36. The T-rail R is thus permitted to pass from the apparatus over the rolls 16.

It will be understood that various changes in the details, materials and arrangements of parts which have been herein described and illustrated in order to explain the nature of the invention, may be made by those skilled in the art within the principle and scope of the invention as expressed in the appended claims.

I claim:

1. Apparatus for the in-line simultaneous grinding of opposite facing surfaces of a workpiece on a fabricating line comprising:

a. a frame;
b. means for fixedly supporting a workpiece with respect to said frame;
c. a crosshead movably mounted on said frame;
d. means for moving said crosshead alternately toward and away from said workpiece;
e. a pair of oppositely spaced motor operated grinding wheels carried by said crosshead;
f. spring means carried by said crosshead to urge said grinding wheels toward one another into engagement with said workpiece during movement of said crosshead toward the same; and
g. cam means on said frame for moving said grinding wheels away from one another during movement of said crosshead away from said workpiece.

2. Apparatus as recited in claim 1 including a pair of oppositely spaced brackets mounting the respective grinding wheels, said brackets being pivotally mounted on said crosshead for movement toward and away from one another.

3. Apparatus as recited in claim 2 in which said cam means comprises:

a. a cam body having sides diverging in the direction away from said workpiece fixedly disposed with respect to said frame; and
b. a cam follower associated with each of said brackets engageable with the respective of said cam sides.

4. Apparatus as recited in claim 3 including means for adjusting the relative position of each of said cam followers with respect to each of said brackets.

5. Apparatus as recited in claim 2 including means for adjusting the spring force urging said brackets toward one another.

6. Apparatus as recited in claim 5 wherein said spring means includes oppositely acting compression springs engaging the remote sides of said brackets and wherein said spring force adjusting means comprises:

a. a rotable threaded shaft mounting said compression springs, said shaft extending transversely of said brackets;
b. stop means at one end of said shaft engaging one of said springs; and
c. a threaded stop movable on said shaft engaging the other of said springs; and
d. means for rotating said shaft with respect to said threaded stop.

7. Apparatus as recited in claim 1 including:

a. oppositely spaced guide posts on said frame;
b. means on said crosshead for slidingly engaging the same on said posts;
c. crank means operatively connected to said crosshead for moving the same in one direction along said posts; and
d. spring means engaging said crosshead for biasing the same in a direction opposite said one direction.

8. Apparatus as recited in claim 1 effective for simultaneously grinding an additional workpiece surface bridging said oppositely facing surfaces including means for fixedly mounting a third motor operated grinding wheel on said crosshead intermediate said pair of oppositely spaced grinding wheels.

9. Apparatus as recited in claim 1 including workpiece stop means selectively engageable with the end of a workpiece, said workpiece stop means being operatively connected to said frame to operatively position said workpiece with respect to said grinding wheels.

10. Apparatus as recited in claim 9 in which said workpiece stop means includes a barrier plate for engaging the end of a workpiece, said plate being movably mounted on said frame for alternate selective insertion into and removable from the path of said workpiece.

* * * * *